US011143429B2

(12) United States Patent
Beauregard

(10) Patent No.: US 11,143,429 B2
(45) Date of Patent: Oct. 12, 2021

(54) CONTROL DEVICE FOR HVAC FAN COIL UNITS

(71) Applicant: ECOBEE INC., Toronto (CA)

(72) Inventor: Graham Beauregard, Oakville (CA)

(73) Assignee: ECOBEE INC., Toronto (CA)

( * ) Notice: Subject to any disclaimer, the term of this patent is extended or adjusted under 35 U.S.C. 154(b) by 0 days.

(21) Appl. No.: 16/376,029

(22) Filed: Apr. 5, 2019

(65) Prior Publication Data

US 2019/0323723 A1 Oct. 24, 2019

Related U.S. Application Data

(60) Provisional application No. 62/653,800, filed on Apr. 6, 2018.

(51) Int. Cl.
*F24F 11/83* (2018.01)
*F24F 11/88* (2018.01)

(52) U.S. Cl.
CPC ..... *F24F 11/83* (2018.01); *F24F 11/88* (2018.01)

(58) Field of Classification Search
CPC .. F24F 11/74; F24F 11/83; F24F 11/88; F24F 2140/20
See application file for complete search history.

(56) References Cited

U.S. PATENT DOCUMENTS

2006/0191677 A1* 8/2006 Viczena ..... F28F 27/02 165/260
2007/0289322 A1* 12/2007 Mathews ..... F24F 11/77 62/225
2007/0289732 A1* 12/2007 Pillion ..... F28F 27/00 165/289
2010/0070088 A1* 3/2010 Josserand ..... F24F 11/30 700/277

(Continued)

OTHER PUBLICATIONS

Lafrance, Patrick,What is the difference 2 pipe and 4 pipe fan coil, Jul. 2015, NEPTRONIC.com, p. 1-3 (Year: 2015).*

*Primary Examiner* — Kidest Bahta
(74) *Attorney, Agent, or Firm* — Perry + Currier Inc.

(57) ABSTRACT

A control device for an HVAC fan control unit includes at least one sensor to provide a signal to the control device to determine the temperature of the working fluid supplied to a coil in the fan control unit. In a first configuration, the sensor determines if the working fluid is above or below a preselected temperature and the control device employs the signal from the sensor to determine if the fan control unit is in a heating or cooling mode. In a second configuration, the sensor measures the temperature of the working fluid and the control device employs the signal from the sensor to determine the heating, or cooling, ability of the fan control unit when utilizing the supplied working fluid. With two-pipe fan control units, a single sensor is employed on the working fluid supply pipe and a single signal representing the working fluid temperature is supplied to the control device. With (Continued)

four-pipe fan control units, a sensor is respectively employed on each of the heating fluid supply pipe and the cooling fluid supply pipe and two signals, each representing the temperature of a respective one of the cooling working fluid and heating working fluid, is supplied to the control device.

11 Claims, 3 Drawing Sheets

(56) References Cited

U.S. PATENT DOCUMENTS

| | | | | |
|---|---|---|---|---|
| 2012/0193066 | A1* | 8/2012 | Lowther | F24F 11/83 165/11.1 |
| 2012/0227954 | A1* | 9/2012 | Uchida | F28D 15/0266 165/253 |
| 2014/0224469 | A1* | 8/2014 | Mirmobin | F24H 9/2007 165/244 |
| 2014/0266755 | A1* | 9/2014 | Arensmeier | F24F 11/62 340/679 |
| 2015/0233597 | A1* | 8/2015 | Dempster | F24F 11/62 165/11.2 |
| 2015/0285528 | A1* | 10/2015 | Sullivan | F24F 1/0018 165/247 |

* cited by examiner

CONTROL DEVICE FOR HVAC FAN COIL UNITS

FIELD OF THE INVENTION

The present invention relates to a control device. More specifically, the present invention relates to a control device for HVAC systems such as fan coil units which are operable to provide environmental heating, cooling and/or to alter other environmental factors.

BACKGROUND OF THE INVENTION

A growing percentage of urban populations, and others, reside in multi-unit residential buildings such as condominiums, apartments or hotels. Such multi-unit residential buildings and other commercial and private buildings ("shared space buildings") have HVAC systems which have a common shared heating and cooling plant. Such shared plants cooperate with one or more installations in each residential unit or office space to provide HVAC services.

Perhaps the most common arrangement of such shared plant systems employs fan coil units (FCUs) in the residential units, office or other occupied spaces. These FCUs typically comprise a water coil and a circulating fan to drive air over the coil. The coil is supplied with water from the shared HVAC plant, the water being circulated to each unit in the shared space building. For heating, the FCU is supplied with heated water, and for cooling the FCU is supplied with chilled water.

In some configurations, the water is supplied to the coil in the FCUs through a single pair of pipes (a supply pipe and a return pipe) and the water is either hot or chilled as selected by the operator of the shared plant. The shared plant is operated to provide heated water when it is anticipated that heating will be required in most units and the plant is operated to provide chilled water when it is anticipated that cooling will be required in most units.

In other cases, the FCU can include two water coils, each of which is supplied by a respective pair of supply and return pipes, one pair supplying heated water and one pair supplying chilled water from the shared plant.

Over the last decade, a variety of significant improvements have been developed for the control of HVAC systems. In particular, intelligent thermostats (such as the Ecobee 3™ and Ecobee 4™ thermostats developed and sold by the Assignee of the present invention) provide numerous efficiency and comfort improvements over conventional thermostats. Such thermostats contain one or more processing units, such as microcontrollers or microprocessors which execute programs stored in memory and which can utilize a variety of inputs and output signals to operate HVAC equipment in an energy efficient manner and with enhanced user comfort.

For example, the above-mentioned ecobee thermostats are wirelessly connected to Internet-based servers which can provide weather forecasts for the location where a respective thermostat is installed to allow the thermostat to predict future HVAC requirements to reduce energy costs and improve comfort levels. Similarly, the ecobee thermostats can determine when to start cooling or heating operations to meet a user defined criteria, such as returning a residence to a selected daytime temperature, from a selected "sleep" temperature, when the residence's user awakes.

Intelligent thermostats, such as those sold by ecobee, provide the above-mentioned and numerous other advantages to users but, to date, such intelligent thermostats have had limited applicability and usefulness for systems employing FCUs.

SUMMARY OF THE INVENTION

It is an object of the present invention to provide a novel control device for HVAC fan coil units or the like which obviates or mitigates at least one disadvantage of the prior art.

According to a first aspect of the present invention, there is provided a control device for controlling an HVAC device including a coil supplied with a working fluid via a supply pipe and a return pipe and a fan to move air over the coil, the control device comprising: a memory containing an operating program; a processor unit executing the operating program; at least one sensor connected to the supply pipe to the coil and operable to provide a signal to the control device; and wherein the processor unit executing the operating program is responsive to the signal to alter the operation of the HVAC device.

According to another aspect of the present invention, there is provided a method of operating a control device controlling an HVAC device comprising at least a first coil supplied with a first working fluid and a fan, the method comprising: (a) determining the temperature of the first working fluid supplied to the first coil; (b) if the determined temperature is above a preselected temperature, the control device operating in a heating configuration to maintain the temperature of the environment served by the control device at a target temperature.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
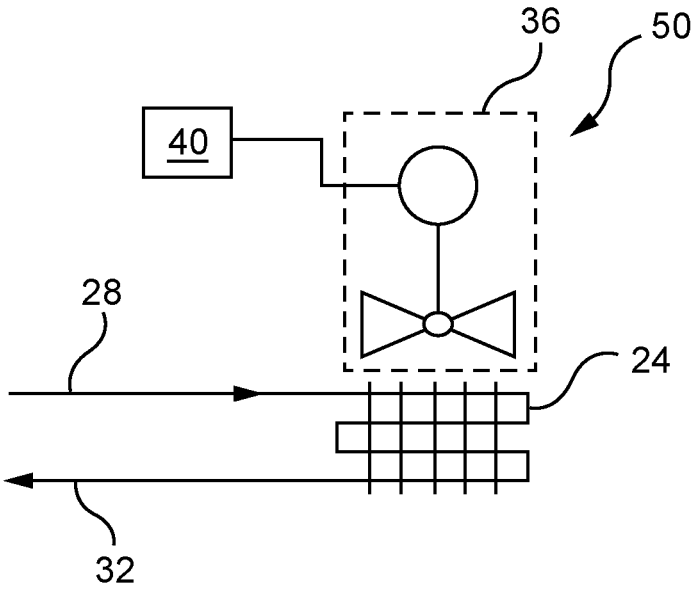
FIG. 1 (PRIOR ART)
FIG. 1 is a prior art two-pipe FCU and control device.

FIG. 1 shows a conventional two-pipe fan coil unit (FCU), indicated generally at 20. FCU 20 has a single water coil 24, which is provided with a supply of operating fluid (typically water) via a supply pipe 28 and return pipe 32. An air circulating fan 36 is operable, under the control of thermostat 40, to circulate air over coil 24 to heat (if the operating fluid is heated water) or cool (if the operating fluid is chilled water) the air passing over it to correspondingly heat, or cool, the surrounding environment.

Figure 2:
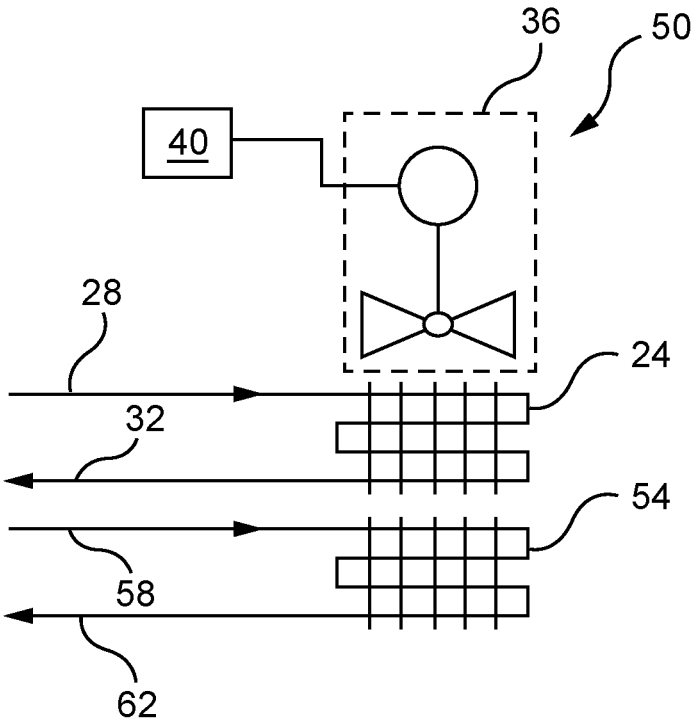
FIG. 2 is a prior art four-pipe FCU and control device.

FIG. 2 shows a conventional four-pipe FCU, indicated generally at 50, wherein like components to those shown in FIG. 1 are indicated with like reference numerals. As shown, FCU 50 further includes a second water coil 54 which is provided with a supply of operating fluid via a supply pipe 58 and a return pipe 62. In this system, coil 24 can act as a cooling coil with supply pipe 28 and return pipe 32 providing chilled water, while coil 54 acts as a heating coil with supply pipe 58 and return pipe 62 providing heated water.

FCU 50 can include a damper which moves to direct circulated air from fan 50 over one of coils 24 and 54 to provide heating, or cooling, as desired.

Four-pipe FCUs are often preferred, as some parts of a shared space building may require heating while other parts require cooling and thus the shared plant may provide both heated and chilled water to the four-pipe systems rather than just one of heated or chilled water to all of the two-pipe FCUs in a shared space building.

While FCUs can provide relatively good energy efficiency by allowing for a shared heating and chilling plant, they suffer from disadvantages in that the existing control systems basically consist of simple thermostats which attempt to keep the temperature within a served environment within a few degrees of a target temperature. However, thermostats for two-pipe FCUs, such as FCU 20, have an additional disadvantage in that the thermostat must be explicitly switched, by a user, between heating and cooling modes to correspond to the condition of the working fluid through coil 42, i.e.—either heated water or chilled water.

If thermostat 40 is incorrectly in heating mode when coil 24 is being supplied with chilled water, the environment served by FCU 20 will not be maintained at the target temperature and, instead, FCU 20 will incorrectly operate to increase the difference between the actual temperature in the environment and the target temperature (i.e.—providing cooling when the actual temperature is below the target temperature). The converse occurs if thermostat 40 is incorrectly in cooling mode when coil 24 is being supplied with heated water.

Figure 3:
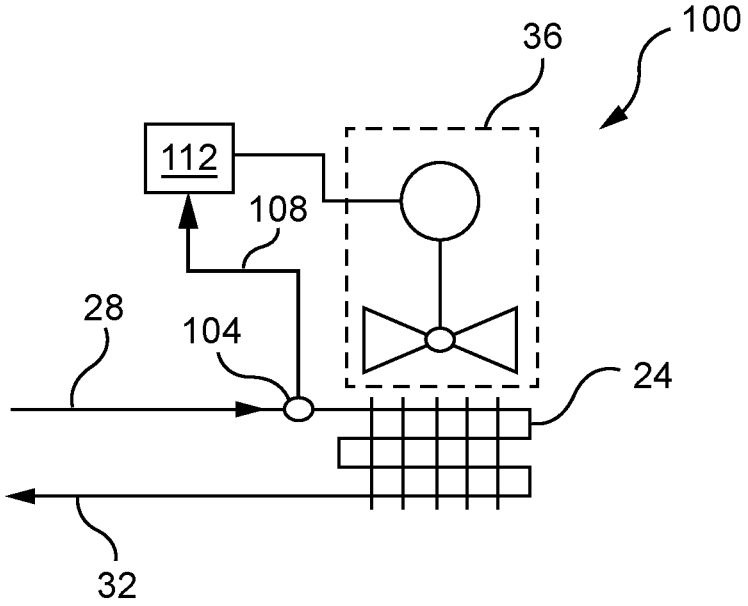
FIG. 3 shows a two-pipe FCU and control device in accordance with the present invention.

FIG. 3 shows a two-pipe FCU unit, indicated generally at 100, incorporating a first embodiment of the present invention, wherein like components to those shown in FIG. 1 are indicated with like reference numerals. In this embodiment, a sensor 104 has been attached to supply pipe 28 and provides an electrical signal 108 to control device 112. In this embodiment, control device 112 can be a smart thermostat, such as the above-mentioned Ecobee 3™ or Ecobee 4™ thermostats.

In the simplest configuration, sensor 104 is a simple "aquastat" which comprises an electrical switch which is open when the working fluid in supply pipe 28 is below a preselected temperature and which is closed when the working fluid is above that preselected temperature. The preselected temperature is a temperature which is expected to only be reached when the working fluid is being heated (rather than chilled) and thus control device 112 is responsive to signal 108 to determine if FCU 100 is operating in heating or cooling mode and control device 112 will operate to control FCU 100 in the correct corresponding manner.

In a more advanced configuration, sensor 104 can be a temperature sensor which measures the temperature of the working fluid in supply pipe 28 and signal 108, provided by sensor 104, indicates that measured temperature to control device 112. In this case, control device 112 will compare the temperature indicated by signal 108 to preselected values stored in control device 112 to determine if FCU 100 is intended to be operated in a cooling or heating mode and will control FCU 100 accordingly. This can provide numerous advantages, as discussed further below, including better handling the case wherein the system is not operating in its intended manner.

For example, in the case of a heavily loaded shared plant, or a shared plant which has experienced a partial failure, the working fluid may not reach the preselected temperature which would trigger an aquastat but may still be able to provide desired heating (or cooling). In such a case, the preset aquastat temperature value might be ninety degrees F. while the working fluid may only be at eighty five degrees F. If sensor 104 informs control device 112 of the eighty five degree temperature of the working fluid, control device 112 can still operate FCU 100 to provide needed heating, albeit perhaps in a less than energy efficient manner.

An additional advantage can also be obtained when sensor 104 supplies a measured temperature value to control device 112 in that control device 112 can implement at least some of the advanced features otherwise available with different HVAC systems equipped with smart thermostats.

Specifically, with shared plant HVAC systems the temperature of the working fluid supplied to FCUs in the system will vary with a variety of factors, including total heating (or cooling) load on the system, the external environmental temperature, the occupancy status of the building, etc. Thus, at sometimes heated working fluid may be supplied to an FCU at (for example) one hundred degrees F. and at other times at ninety degrees F.

In use cases without a shared heating and cooling plant, such as a single family dwelling with a force air heating/cooling system, a smart thermostat such as the Ecobee Smart™ thermostats mentioned above, will "learn" the parameters of the dwelling such that the thermostat can operate to offer improved user comfort and energy efficiency.

For example, it has long been a feature of simple programmable thermostats to allow users to program different target temperatures into their thermostat corresponding to different times of day and/or different days of the week. Thus, a user may program a lower target temperature for periods when they expect to be sleeping and/or an even lower target temperature when they expect their residence (or other environmental space) to be unoccupied. In such cases, the user defines the relevant times for the thermostat to use the different target temperatures and the simple programmable thermostat employs the preset target temperature which corresponds to the programmed time/day.

However, such an implementation requires the user to make assumptions about how long their specific environment takes to cool or be heated to a target temperature. For example, if a user programs their thermostat to define their sleep period to be between 10:00 PM and 7:00 AM on weekdays, the thermostat merely reduces the target temperature at 10:00 PM and increases it, accordingly, at 7:00 AM without accounting for the time required for the environment served by the thermostat to cool down to the reduced target temperature or the time required for the served environment to be reheated to the higher target temperature.

In fact, if the user wishes to experience the reduced temperature at 10:00 PM, the thermostat should reduce the heating provided to the environment some period before that time and, similarly, if the user wants the temperature returned to the wake up value at 7:00 AM, the thermostat should start raising the temperature sometime before 7:00 AM.

Even if the user tries to compensate for these time differences, the time required for the environment to cool to the sleep temperature and/or rise to the wake temperature will vary depending upon a variety of factors, such as the external temperature. As will be apparent, ignoring these factors, as simple programmable thermostats do, results in reduced user comfort and/or increased energy use/cost.

As mentioned above, smart thermostats "learn" the parameters of the environment they serve and can determine how long will be required for the environment they control to cool to a reduced target temperature and/or how long will be required to heat the environment they control to a higher target temperature thus improving user comfort and providing improved energy efficiencies.

Thus, for the example discussed above, in mild external conditions the smart thermostat may stop heating the user's environment at 9:30 PM so that the environment will cool to the desired sleep temperature by 10:00 PM. However, in cold external conditions, the smart thermostat will stop heating the user's environment at 9:50 PM as it has determined that the cool down will occur more rapidly and the target sleep temperature will be reached by 10:00 PM. Similarly, the smart thermostat may start heating the user's environment at 6:45 AM in mild external conditions but start heating the user's environment at 6:30 AM in cold external conditions, to heat the environment to the desired wake temperature by 7:00 AM.

However such improvements have not, to date, been available to environments served by FCUs, both because smart thermostats have not been available for FCU units, but also because one of the learned parameters a smart thermostat requires to determine relevant cool down and reheat periods is the capacity of the managed HVAC system to apply heat, or cooling, to the controlled environment. Unlike independent residences and other environments with stand alone furnaces and AC systems, in environments serviced by FCUs, the temperature of the working fluid(s) supplied to the FCU can vary. As is apparent, the speed with which an FCU can raise the temperature within the environment it serves depends upon the temperature of the heating fluid provided to it. Similar issues exist with the FCUs ability to cool the environment it serves which depends on the temperature of the cooling fluid provided to it.

Accordingly, when signal 108 from sensor 104 informs control device 112 of the temperature of the working fluid in supply pipe 28, control device 112 can use this working fluid temperature information as one of the factors in its calculations. Specifically, control device 112 will determine the capability of the FCU to raise (or lower) the temperature of the environment it controls responsive to the temperature of the working fluid supplied to it and will adjust its calculations accordingly.

Figure 4:
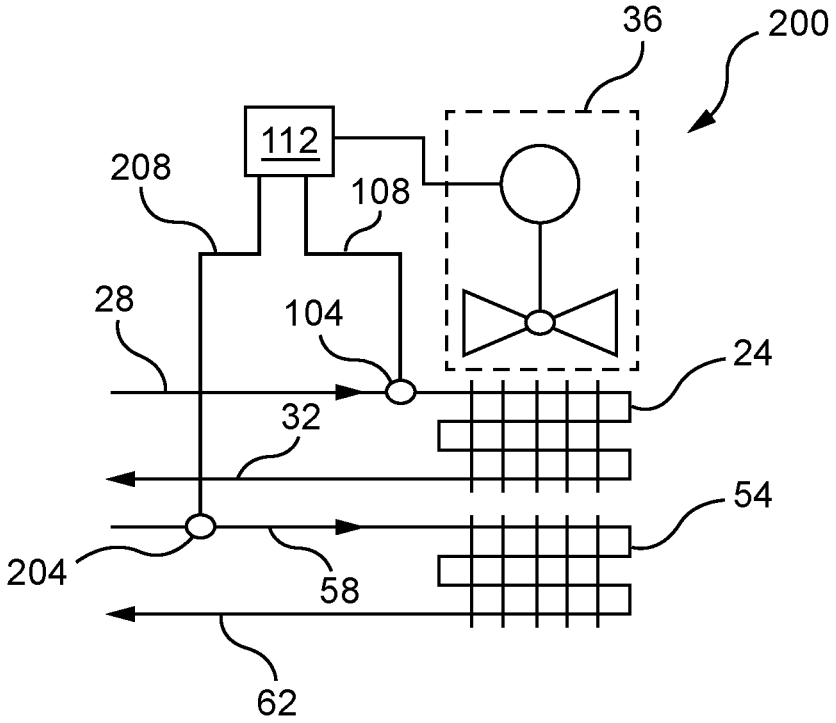
FIG. 4 shows a four-pipe FCU and control device in accordance with the present invention.

FIG. 4 shows a four-pipe FCU unit, indicated generally at 200, incorporating another embodiment of the present invention, wherein like components to those shown in FIG. 2 are indicated with like reference numerals. A sensor 204 has been attached to supply pipe 58 and provides an electrical signal 208 to control device 112. In this embodiment, sensor 104 provides signal 108 to control device 112 to indicate a measured temperature of the chilled working fluid supplied to coil 24 and sensor 204 provides signal 208 to control device 112 to indicate a measured temperature of the hot working fluid supplied to coil 54.

In addition to the functions and features described above with respect to the embodiment of FIG. 3, FCU system 200 provides additional advantages and functions to those provided by FCU system 100. For example, system 200 can learn its relevant operating parameters, both for heating and cooling modes of operation, enabling operation to enhance user comfort and energy efficiency. Further, in some cases it is desired to operate both coils 24 and 54 (cooling and heating) of system 200 simultaneously to dehumidify the environment. In such a case, control device 112 can also control the damper (not shown) to cause the airflow from fan 36 to first flow over cooling coil 24 and then over heating coil 54 to dehumidify the air. The damper can vary the relative amounts of air flowing over both, neither or either of coils 24 and 54, corresponding to the temperatures measured by signals 108 and 208, to achieve the desired dehumidification without significantly altering the temperature of the environment served by FCU 200.

Further, by knowing the temperature of both working fluids supplied to FCU 200, control device 112 is better able to detect error conditions and/or malfunctions in the shared plant. For example, control device 112 can issue an alarm if the temperature of the chilled working fluid reported by sensor 104 exceeds a preset value, for example above 80 degrees, or if the temperature of the heated working fluid, reported by sensor 208, falls below a preset value, for example below 60 degrees.

Figure 5:
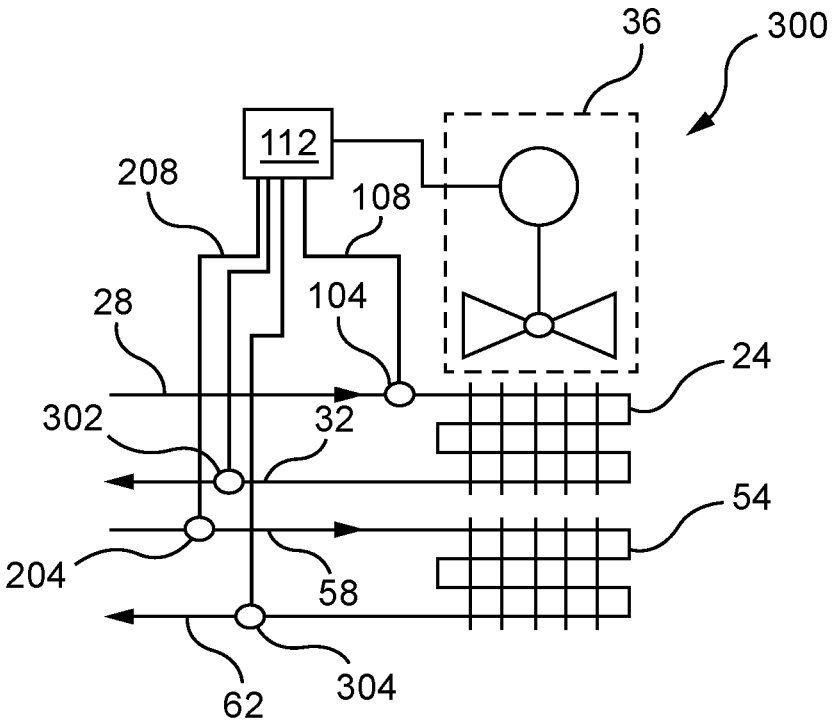
FIG. 5 shows another four-pipe FCU and control device in accordance with the present invention.

FIG. 5 shows another four-pipe FCU unit, indicated generally at 300, incorporating another embodiment of the present invention, wherein like components to those shown in FIG. 4 are indicated with like reference numerals. FCU 300 includes two temperature sensors for each of coil 24 and coil 54, with sensor 104 on supply pipe 28 to cooling coil 24 and a sensor 302 on the return pipe of cooling coil 24 and sensor 204 on the supply pipe 58 of heating coil 54 and a sensor 304 on the return pipe 58 of heating coil 54.

In this manner, FCU 300 can determine the temperature drop, or rise, across a respective coil to diagnose conditions such as a defective fan or blocked filter. Further, FCU 300 can use the temperature change across the respective coil as an input when considering the desired operating speed of fan 36.

For example, FCU 300 can determine the temperature change across a respective one of coils 24 and 54 and can increase the operating speed (and airflow) of fan 36 if the temperature change is less than a predetermined value (indicating to control device 112 that a more rapid adjustment of the environment's temperature can be achieved) and/or can decrease the operating speed (and airflow) of fan 36 if the temperature change is more than a predetermined value (indicating to control device 112 that a less rapid adjustment of the environment's temperature must be pursued).

The present invention provides a novel control device for an HVAC fan control unit. The control device includes at least one sensor to provide a signal to the control device to determine the temperature of the working fluid supplied to a coil in the fan control unit. In a first configuration, the sensor determines if the working fluid is above or below a preselected temperature and the control device employs the signal from the sensor to determine if the fan control unit is in a heating or cooling mode. In a second configuration, the sensor measures the temperature of the working fluid and the control device employs the signal from the sensor to determine the heating, or cooling, ability of the fan control unit when utilizing the supplied working fluid. With two-pipe fan control units, a single sensor is employed on the working fluid supply pipe and a single signal representing the working fluid temperature is supplied to the control device. With four-pipe fan control units, a sensor is respectively employed on each of the heating fluid supply pipe and the cooling fluid supply pipe and two signals, each representing the temperature of a respective one of the cooling working fluid and heating working fluid, is supplied to the control device.

The above-described embodiments of the invention are intended to be examples of the present invention and alterations and modifications may be effected thereto, by those of skill in the art, without departing from the scope of the invention which is defined solely by the claims appended hereto.

I claim:

1. A control device for controlling an HVAC device of a unit of a building, the HVAC device including a coil supplied with a working fluid via a supply pipe and a return pipe and a fan to move air over the coil, the control device comprising:

a memory containing an operating program;

a processor unit executing the operating program;

at least one sensor connected to the supply pipe to the coil and operable to provide a signal to the control device; and wherein the processor unit executing the operating program is responsive to the signal to alter the operation of the HVAC device;

wherein the supply pipe is connected to a shared heating and chilling plant to deliver the working fluid with a temperature that serves the building that contains a plurality of units that include a plurality of HVAC devices, including the unit served by the HVAC device;

wherein, if the signal indicates the working fluid in the supply pipe is above a preset temperature, the control device operates as if the HVAC device is in a heating configuration;

wherein if the signal indicates the working fluid in the supply pipe is below the preset temperature, the control device operates as if the HVAC device is in a cooling configuration.

2. A control device according to claim 1 wherein the HVAC device includes both a cooling coil and a heating coil, the cooling coil having a supply pipe and a return pipe for a cooling working fluid and the heating coil having a supply pipe and a return pipe for a heating working fluid, the sensor sensing the temperature of the working fluid supplied to the cooling coil and further including a second sensor sensing the temperature of the working fluid supplied to the heating coil, the control device responsive to the signals from both sensors to alter the operation of the HVAC device.

3. A control device according to claim 1 wherein the HVAC device includes both a cooling coil and a heating coil, the cooling coil having a supply pipe and a return pipe for a cooling working fluid and the heating coil having a supply pipe and a return pipe for a heating working fluid, and the control device further including a first sensor sensing the temperature of the working fluid in the supply pipe for the cooling coil and a second sensor sensing the temperature of the working fluid in the return pipe from the cooling coil and a third sensor sensing the temperature of the working fluid in the supply pipe to the heating coil and a fourth sensor sensing the temperature of the working fluid in the return pipe from the heating coil, each sensor providing a respective signal to the control device representing the respective sensed temperature and the control device responsive to the signals from the four sensors to alter the operation of the HVAC device.

4. A control device according to claim 3 wherein the processor processes the signals from the four sensors to determine the temperature change across the heating coil and across the cooling coil.

5. A control device according to claim 1, wherein the processor unit executing the operating program is determine whether the HVAC device is operating in a heating mode or a cooling mode based on a temperature measured by the sensor connected to the supply pipe.

6. A control device according to claim 5, wherein the processor unit executing the operating program is to compare the temperature measured by the sensor to a preselected temperature to determine whether the HVAC device is operating in the heating mode or the cooling mode.

7. A method of operating a control device controlling an HVAC device of a unit of a building, the HVAC device comprising at least a first coil supplied with a first working fluid and a fan, the method comprising:

(a) determining with a sensor at a supply pipe of the first coil the temperature of the first working fluid supplied to the first coil;

(b) if the determined temperature is above a preselected temperature, the control device operating in a heating configuration to maintain the temperature of the environment served by the control device at a target temperature, wherein the first coil is connected to a shared heating and chilling plant by the supply pipe to deliver the first working fluid with a first temperature that serves the building that contains a plurality of units that include a plurality of HVAC devices, including the unit that includes the HVAC device served by the control device; and (c) if the determined temperature is below the preselected temperature, the control device operating in a cooling configuration to maintain the temperature of the environment served by the control device at a target temperature.

8. A method according to claim 7 further comprising determining whether the HVAC device is operating in a heating mode or a cooling mode based on the temperature of the first working fluid supplied to the first coil.

9. A method according to claim 8 further comprising comparing the temperature of the first working fluid to a preselected temperature to determine whether the HVAC device is operating in the heating mode or the cooling mode.

10. A control device comprising:

a first sensor connectable to a heating fluid supply pipe of a fan coil unit (FCU) that includes a heating coil to circulate heated working fluid and a fan to force air over the heating coil, wherein the heating fluid supply pipe is to supply the heated working fluid from a plant shared by a plurality of FCUs to the heating coil of the FCU, wherein the first sensor is to sense a first temperature of the heated working fluid in the heating fluid supply pipe;

a second sensor connectable to a cooling fluid supply pipe of the FCU, which further includes a cooling coil to circulate chilled working fluid, wherein the cooling fluid supply pipe is to supply the chilled working fluid from the plant shared by the plurality of FCUs to the cooling coil of the FCU, wherein the second sensor is to sense a second temperature of the chilled working fluid in the cooling fluid supply pipe; and a processor connected to the first sensor and the second sensor, the processor configured to operate the FCU by controlling air flow by the fan over the heating coil or the cooling coil based on the first temperature or the second temperature, wherein: when the processor determines that the temperature of the heated working fluid exceeds a preset value, then the processor controls the FCU to operate in a heating mode.

11. The control device of claim 10, wherein, when the processor determines that the temperature of the chilled working fluid is below another pre-set value, then the processor controls the FCU to operate in a cooling mode.

* * * * *